US011626660B2

(12) United States Patent
Wu et al.

(10) Patent No.: US 11,626,660 B2
(45) Date of Patent: Apr. 11, 2023

(54) DUAL-FREQUENCY CURRENT-BALANCING QUADRIFILAR HELICAL ANTENNA

(71) Applicant: HARXON CORPORATION, Guangdong (CN)

(72) Inventors: Wenping Wu, Guangdong (CN); Jie Wang, Guangdong (CN)

(73) Assignee: HARXON CORPORATION, Guangdong (CN)

( * ) Notice: Subject to any disclaimer, the term of this patent is extended or adjusted under 35 U.S.C. 154(b) by 296 days.

(21) Appl. No.: 16/977,067

(22) PCT Filed: Dec. 6, 2019

(86) PCT No.: PCT/CN2019/123712

§ 371 (c)(1),
(2) Date: Aug. 31, 2020

(87) PCT Pub. No.: WO2020/114498

PCT Pub. Date: Jun. 11, 2020

(65) Prior Publication Data

US 2020/0403304 A1 Dec. 24, 2020

(30) Foreign Application Priority Data

Dec. 7, 2018 (CN) ..... 201811490695.0

(51) Int. Cl.
*H01Q 1/36* (2006.01)
*H01Q 1/50* (2006.01)
(Continued)

(52) U.S. Cl.
CPC ..... *H01Q 1/50* (2013.01); *H01Q 1/362* (2013.01); *H01Q 1/48* (2013.01); *H01Q 9/27* (2013.01)

(58) Field of Classification Search
CPC ..... H01Q 1/36; H01Q 1/48–50; H01Q 9/27; H01Q 11/08
See application file for complete search history.

(56) References Cited

U.S. PATENT DOCUMENTS 6,184,844 B1 * 2/2001 Filipovic ..... H01Q 1/362 343/895
6,278,414 B1 * 8/2001 Filipovic ..... H01Q 1/362 343/895

(Continued)

FOREIGN PATENT DOCUMENTS

CN 1301416 A 6/2001
CN 1716688 A 1/2006

(Continued)

*Primary Examiner* — Hasan Islam
(74) *Attorney, Agent, or Firm* — Seed IP Law Group LLP

(57) ABSTRACT

The present disclosure relates to the technical field of antennas and provides a dual-frequency current-balancing quadrifilar helical antenna, which belongs to the technical field of antennas in multi-mode global satellite navigation system. The dual-frequency current-balancing quadrifilar helical antenna comprises a radiating part and a feeding part, wherein: the radiating part comprises a hollow column and four sets of spiral arms with the same specifications and equal intervals; the spiral arms are wound on a surface of the hollow column and the feeding part is mounted at an end of the hollow column; each set of spiral arms comprises a main radiating arm and an auxiliary radiating arm; terminals of the main radiating arm and the auxiliary radiating arm are open-circuited or short-circuited, and a coupling component is arranged at an open-circuited or short-circuited terminal. The dual-frequency current-balancing quadrifilar helical antenna provided in the present disclosure can increase the energy of a parasitic frequency band, improve the performance of the parasitic frequency band, and reduce the size of the antenna.

11 Claims, 5 Drawing Sheets

(51) Int. Cl.
*H01Q 1/48* (2006.01)
*H01Q 9/27* (2006.01)

(56) References Cited

U.S. PATENT DOCUMENTS

| | | | | |
|---|---|---|---|---|
| 10,700,430 | B1 * | 6/2020 | Abbasi | H01Q 1/38 |
| 2011/0254755 | A1 * | 10/2011 | DiNallo | H01Q 11/08<br>343/893 |

FOREIGN PATENT DOCUMENTS

| | | | |
|---|---|---|---|
| CN | 205355247 | U | 6/2016 |
| CN | 109509968 | A | 3/2019 |
| WO | 2018130145 | A1 | 7/2018 |

* cited by examiner

DUAL-FREQUENCY CURRENT-BALANCING QUADRIFILAR HELICAL ANTENNA

FIELD

The present disclosure relates to a dual-frequency current-balancing quadrifilar helical antenna and belongs to the technical field of antennas in multi-mode global satellite navigation system.

BACKGROUND

Global Navigation Satellite System (GNSS) has a wide range of applications in various aspects of the society. Compared with a single satellite navigation system, multi-mode navigation has the advantages of wider coverage, higher navigation accuracy, and more stable operation. This makes multi-mode navigation a big trend in the development of satellite navigation industry in the future. As an important part of a satellite navigation system, the performance of the antenna has a great impact on the performance of the navigation system. Therefore, it is of great significance to study multi-mode satellite navigation antennas.

The conventional quadrifilar helical antenna generally adopts the method of bending a radiating arm on the top (or bottom) or placing a short-circuited or open-circuited auxiliary radiating arm directly beside a main radiating arm to achieve dual-frequency characteristics. However, both approaches have the same drawback, that is due to the imbalance of currents between the main radiating arm and the auxiliary radiating arm, the energy of a parasitic frequency band is generally lower than the energy of the main frequency band. This affects the performance of the antenna.

SUMMARY

The present disclosure is provided to resolve the issues caused by an imbalance of currents between a main radiating arm and an auxiliary radiating arm of a quadrifilar helical antenna in the prior art. The imbalance of currents is the reason why the energy of a parasitic frequency band is lower than the energy of a main frequency band, which affects the performance of an antenna.

The present disclosure provides a dual-frequency current-balancing quadrifilar helical antenna, comprising a radiating part and a feeding part, wherein: the radiating part comprises a hollow column and four sets of spiral arms with the same specifications and equal intervals; the spiral arms are wound on a surface of the hollow column and the feeding part is mounted at an end of the hollow column; each set of spiral arms comprises a main radiating arm and an auxiliary radiating arm; terminals of the main radiating arm and the auxiliary radiating arm are open-circuited or short-circuited, and a coupling component is arranged between the main radiating arm and the auxiliary radiating arm.

According to an example of the present disclosure, a dual-frequency current-balancing quadrifilar helical antenna further comprises an outer housing and a cable, wherein a radiating part and a feeding part are wrapped in the outer housing, and the cable is connected with the feeding part.

According to an example of the present disclosure, a spiral rising angle of a main radiating arm and a spiral rising angle of a auxiliary radiating arm are the same or different.

According to an example of the present disclosure, a feeding part comprises a circular polarized feeding component, wherein: the circular polarized feeding component can be a network splitting one into four subnets consisting of a electrical bridge or pure media; an input port of the network is connected with a cable; each output port has the same amplitude and a phases difference of 90° in sequence; and four output ports are connected with four sets of spiral arms, respectively.

According to an example of the present disclosure, a rotation direction of the main radiating arm and the auxiliary radiating arm is right-handed or left-handed; the widths of the main radiating arm and the auxiliary radiating arm are uniform or gradually varied; and the terminals of the main radiating arm and the auxiliary radiating arm are open-circuited or short-circuited.

According to an example of the present disclosure, the spiral arms are made by printing on a dielectric substrate, and the hollow column is a light-weight and low-loss material or consists of air.

According to an example of the present disclosure, there are three ways to arrange a coupling component:

(1) a coupling component comprises two coupling plates with flush ends arranged on the main radiating arm and the auxiliary radiating arm, respectively;

(2) a coupling component comprises two coupling plates with zigzag-shaped ends arranged on the main radiating arm and the auxiliary radiating arm, respectively; and (3) a coupling component comprises a coupling plate printed on the back of spiral arms.

According to an example of the present disclosure, an arrangement direction of a coupling component is perpendicular to an overall arrangement direction of a dual-frequency current-balancing quadrifilar helical antenna.

Compared with the prior art, the technical solutions provided in the examples of the present disclosure have the following advantages: in the above solutions, in a dual-frequency current-balancing quadrifilar helical antenna provided in the present disclosure, as compared with the prior art, the gain bandwidths of two frequency bands are equivalent and have a relatively high radiation efficiency when other performances of the antenna are guaranteed. A coupling component is added between a main radiating arm and an auxiliary radiating arm to balance the currents between the main and auxiliary radiating arms, thereby increasing the energy of a parasitic frequency band and consequently improving the performance of the parasitic frequency band. At the same time, since an introduction of a coupling component is equivalent to increasing the electrical length, the size of the antenna is reduced.

BRIEF DESCRIPTION OF THE DRAWINGS

The drawings herein are incorporated into the specification and constitute a part of the specification. The drawings show examples conforming to the present disclosure and are used together with the specification to explain the principle of the present disclosure.

In order to explain the technical solutions more clearly in the examples of the present disclosure or the prior art, the drawings used in the examples or the description of the prior art are briefly explained. Obviously, one skilled in the art can obtain other drawings based on these drawings without involving creative efforts.

DESCRIPTION OF MAIN COMPONENT SYMBOLS

1. Hollow column; 2. Spiral arms; 3. Main radiating arm; 4. Auxiliary radiating arm; 5. Coupling component; 6, 7, 8. Optional coupling components; 9. Circular polarized power feeding component; 10. Outer housing; 11. Cable.

DETAILED DESCRIPTION

In order to make the objects, technical solutions and advantages of the examples in the present disclosure clearer, some examples of the technical solutions of the present disclosure will be described clearly and completely with reference to the drawings of the examples in the present disclosure. It is obvious that the examples as described are only some of the examples of the present disclosure, rather than all the examples. Based on the examples in the present disclosure, all other examples obtained by one skilled in the art without involving inventive effort fall within the protection scope of the present disclosure.

Example 1

Figure 1:
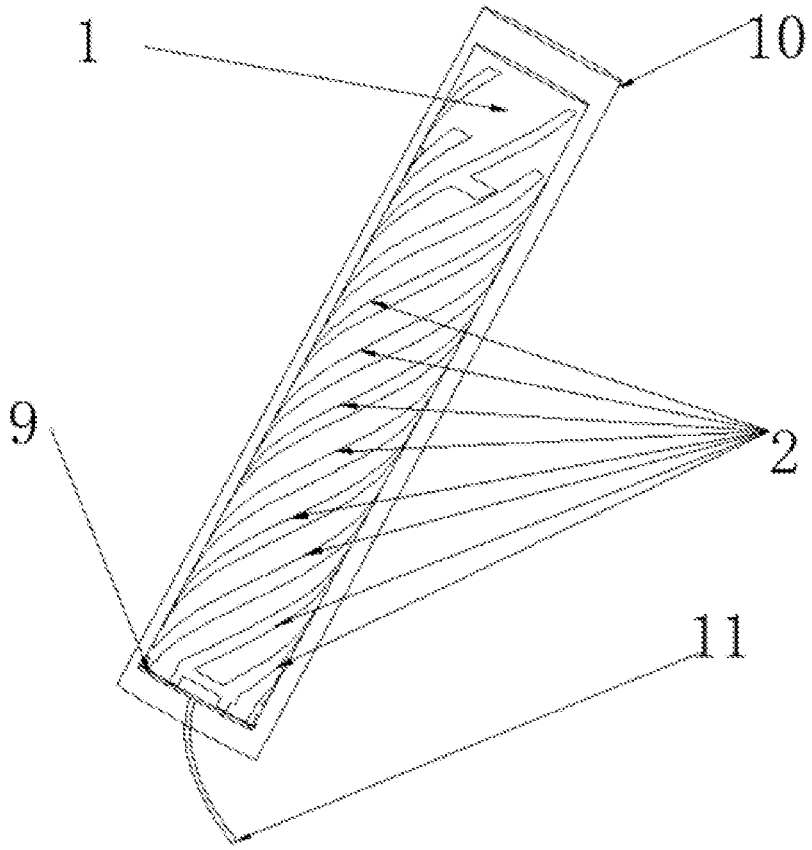
FIG. 1 shows a schematic diagram illustrating a structure of a dual-frequency current-balancing quadrifilar helical antenna in Example 1.
Figure 2:
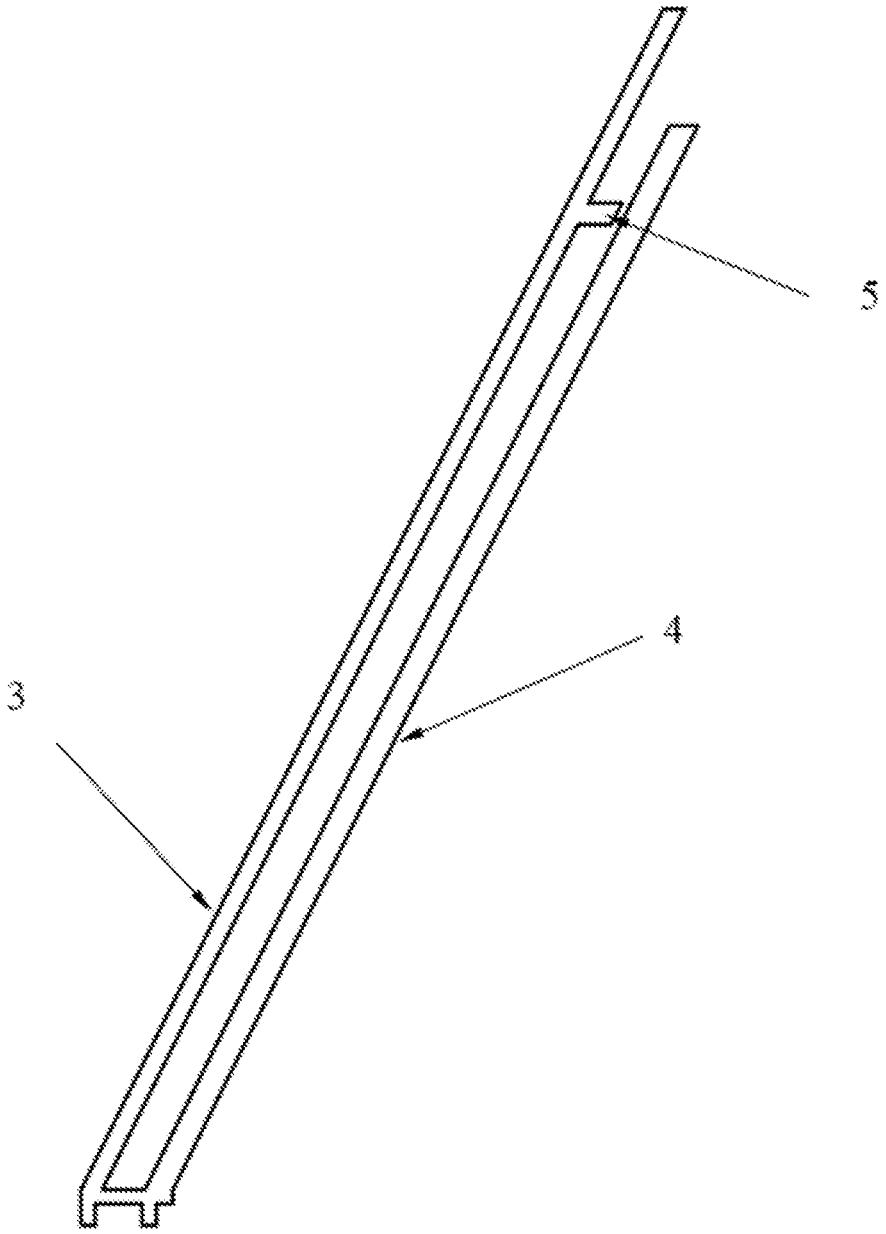
FIG. 2 shows a schematic diagram illustrating a structure of the part of the spiral arms in FIG. 1.

As shown in FIG. 1 and FIG. 2, a dual-frequency current-balancing quadrifilar helical antenna includes a radiating part, a feeding part, a outer housing 10, and a cable 11, wherein the radiating part comprises four sets of spiral arms 2 tightly wound on the surface of the hollow column 1, the feeding part consists of a circular polarized feeding component 9 installed under the hollow column, and the outer housing 10 used for protection and beauty purposes closely surrounds the radiating part and the feeding part. The cable 11 extends out the outer housing 10.

The four sets of spiral arms 2 have the same structural specifications and are arranged at equal intervals. Each set of spiral arms comprises a main radiating arm 3 and an auxiliary radiating arm 4. A coupling component 5 between the main radiating arm and the auxiliary radiating arm balances the current between the main radiating arm and the auxiliary radiating arm and at the same time increases the effective electrical lengths of the main radiating arm 3 and the auxiliary radiating arm 4 and reduces the size of the antenna.

The position of the coupling component 5 can be at any position of the main radiating arm 3 and the auxiliary radiating arm 4. The position generally relates to the working frequency of the antenna and the energy distribution of the main radiating arm and the auxiliary radiating arm in order to balance the energy distribution of the main radiating arm and the auxiliary radiating arm. The energy distribution of the main radiating arm 3 and the auxiliary radiating arm 4 relates to their lengths, end forms, widths, the distance between them, and their rising angles. As shown in FIG. 1, the main radiating arm and auxiliary radiating arm are open-circuited. The coupling component 5 is located at proximity of the terminal of the main radiating arm 3.

The length and width of the coupling component 5 generally relate to the working frequency of the antenna and the energy distribution of the main radiating arm and the auxiliary radiating arm.

The coupling component 5 is generally parallel to the horizontal plane, while the antenna is generally placed perpendicular to the ground.

The spiral rising angle of the main radiating arm 3 and the auxiliary radiating arm 4 of each group of spiral arms 2 can be the same or different.

The rotation direction of each group of spiral arms 2 can be right-handed or left-handed.

The width of the metal plate of each group of spiral arms 2 can be uniform or gradually varied.

One terminal of the metal plate of the main radiating arm 3 and the auxiliary radiating arm 4 of each group of the spiral arms 2 with the coupling component 5 can be short-circuited or open-circuited.

The other terminal of the metal plate of the main radiating arm 3 and the auxiliary radiating arm 4 of each group of the spiral arms 2 without the coupling component 5 can be short-circuited or open-circuited.

The four sets of spiral arms 2 are printed on a thin dielectric substrate. The spiral arms 2 can be tightly wound on the surface of the hollow column 1 without dielectric substrate.

A circular polarized feeding component 9 can be a network splitting one into four subnets consisting of an electrical bridge or pure media. The input ports is connected with a cable. Each output port has the same amplitude and a phase difference of 90° in sequence. The output ports are connected with the four sets of spiral arms, respectively.

The circular polarized feeding component 9 can be at the top of the hollow column 1 or at the bottom of the hollow column 1.

The hollow column 1 can be made of light-weight and low-loss material or air.

Example 2

Figure 3:
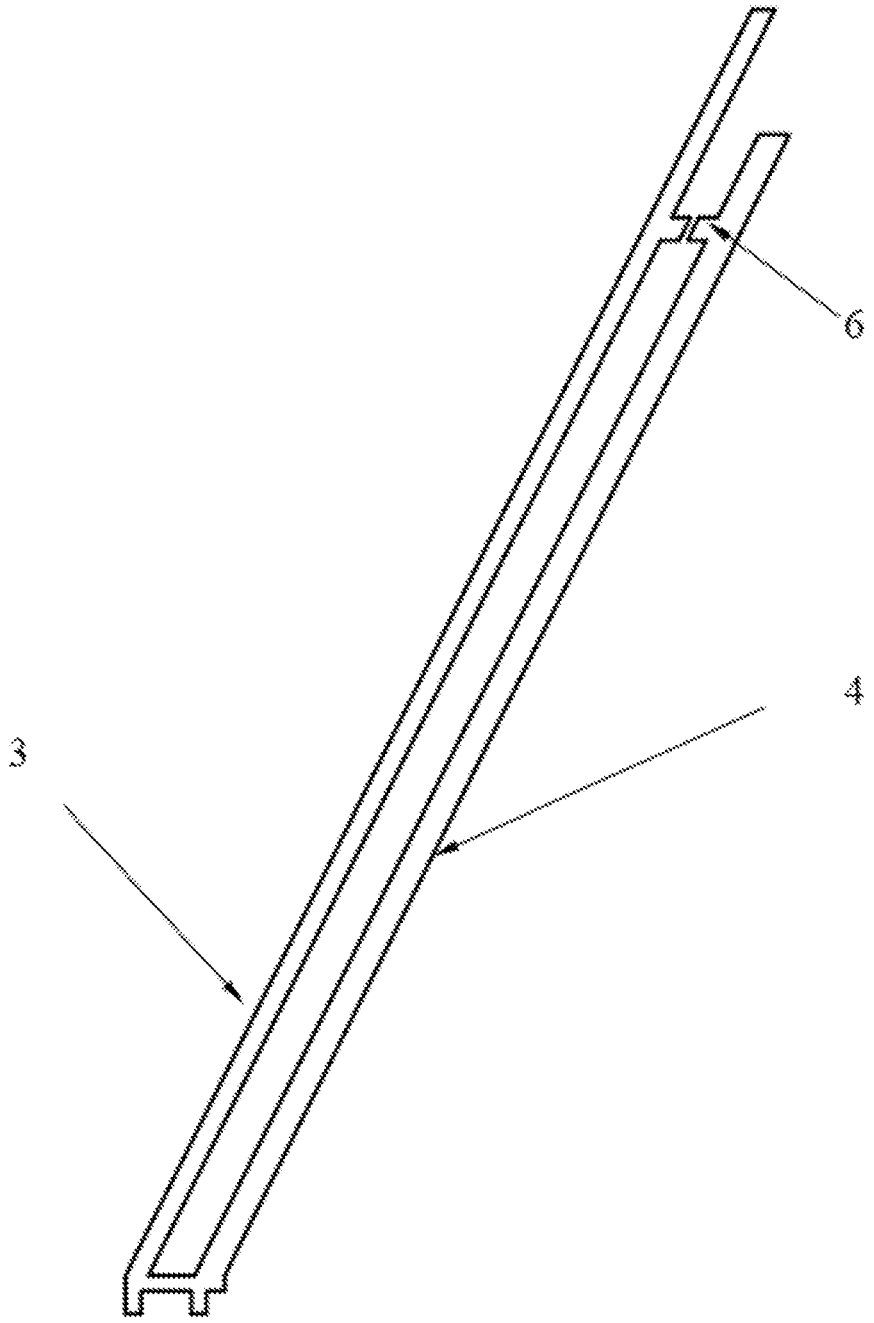
FIG. 3 shows a schematic diagram illustrating a structure of the arrangement of coupling components in Example 2.

As shown in FIG. 3, the present example provides the second specific arrangement of the coupling component 5.

One terminal of the main radiating arm 3 and the auxiliary radiating arm 4 with the coupling component 5 is open-circuited. The terminals of the main radiating arm 3 and the auxiliary radiating arm 4 are open-circuited. The optional coupling component 6 comprises two coupling plates with flush ends arranged on the main radiating arm 3 and the auxiliary radiating arm 4, respectively. The coupling plates are metal plates.

Example 3

Figure 4:
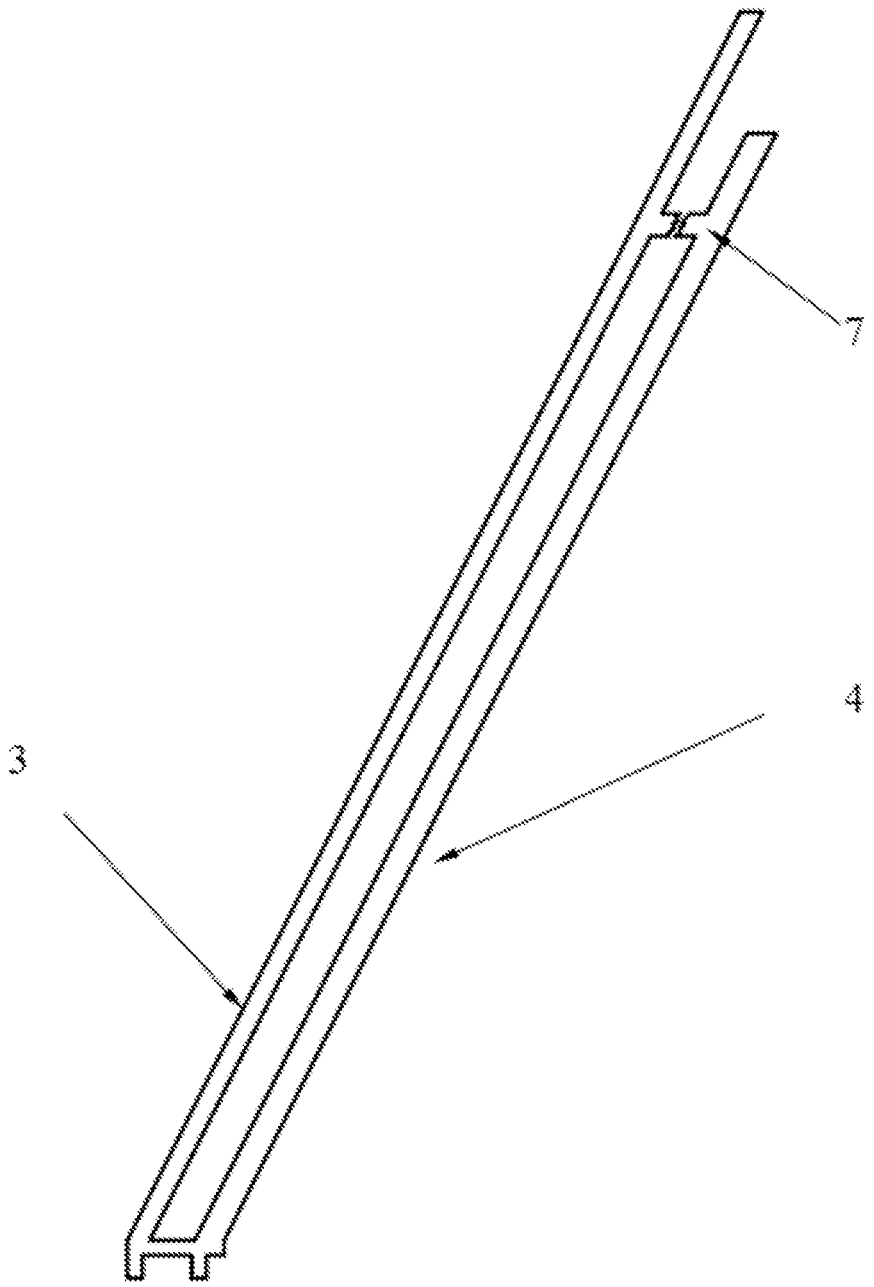
FIG. 4 shows a schematic diagram illustrating a structure of the arrangement of coupling components in Example 3.

As shown in FIG. 4, the present example provides the third specific arrangement of the coupling component 5.

The terminals of the main radiating arm 3 and the auxiliary radiating arm 4 are open-circuited. The optional coupling component 7 comprises two coupling plates with zigzag-shaped ends arranged on the main radiating arm 3 and the auxiliary radiating arm 4, respectively. The coupling plate is metal plate.

Example 4

Figure 5:
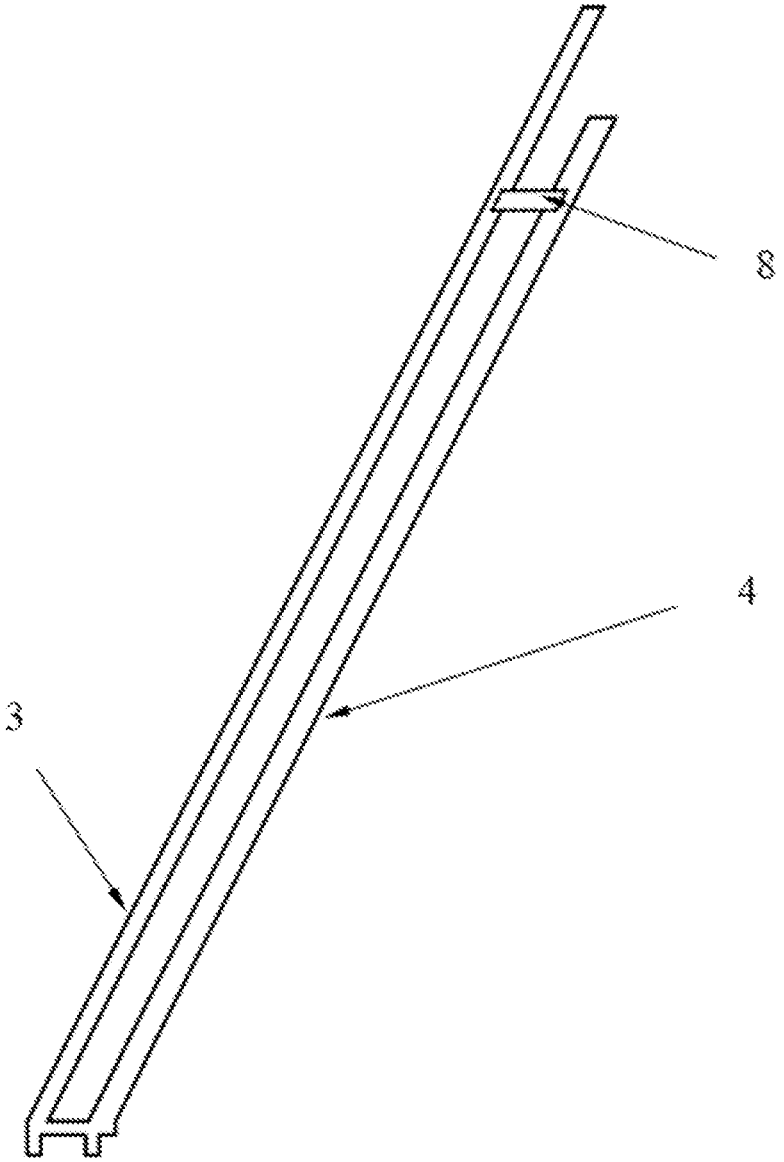
FIG. 5 shows a schematic diagram illustrating a structure of the arrangement of coupling components in Example 4.

As shown in FIG. 5, the present example provides the forth specific arrangement of the coupling component 5. The terminals of the main radiating arm 3 and the auxiliary radiating arm 4 are open-circuited.

The optional coupling component 8 comprises coupling plates printed on the back of the main radiating arm 3 and the auxiliary radiating arm 4, as shown in FIG. 5, indicated by dashed lines. The coupling plate is a metal plate.

In Examples 2, 3, and 4, in view of the different distributions of energy on a main radiating arm 3 and the auxiliary radiating arm 4, different forms of optional coupling assemblies are respectively arranged, and their functions are to balance the current of the main radiating arm 3 and the auxiliary radiating arm 4 through the electrical coupling effects of the coupling assemblies. As a result, the energy of a parasitic frequency band is increased and the performance of the parasitic frequency band is improved. At the same time, the introduction of the coupling assembly is equivalent to increasing the electrical length, thus the antenna size is reduced.

It should be noted that in this disclosure, relational terms such as "first", "second" and the like are only used to distinguish one entity or operation from another entity or operation, and do not necessarily require or imply that there is any such actual relationship or sequence among entities or operations. Moreover, the terms "comprise", "include" or any other variants thereof are intended to cover non-exclusive inclusion, so that a process, method, article, or device that comprises a series of elements comprises not only those elements, but those other elements that are not explicitly listed, or also comprises elements inherent to this process, method, article or equipment. If there are no more restrictions, the element defined by the sentence "comprising a . . . " does not exclude the existence of other same elements in the process, method, article, or equipment that comprises the element.

The above are only specific embodiments of the present disclosure to enable one skilled in the art to understand or implement the disclosure. Various modifications to these examples will be obvious to one skilled in the art, and the general principles defined herein can be implemented in other examples without departing from the spirit or scope of the present disclosure. Therefore, the present disclosure will not be limited to the examples shown in the present disclosure, but should conform to the widest scope consistent with the principles and novel features of the present disclosure.

What is claimed is:

1. A dual-frequency current-balancing quadrifilar helical antenna, comprising:

a radiating part, a feeding part, an outer housing, and a cable connected with the feeding part;

wherein the radiating part comprises a hollow column and 4 sets of spiral arms with same specifications and equal intervals;

the spiral arms are wound on a surface of the hollow column and the feeding part is mounted at an end of the hollow column;

each set of the spiral arms comprises a main radiating arm and an auxiliary radiating arm;

terminals of the main radiating arm and the auxiliary radiating arm are open-circuited or short-circuited;

a coupling component is arranged between the main radiating arm and the auxiliary radiating arm; and wherein the radiating part and the feeding part are wrapped in the outer housing.

2. The dual-frequency current-balancing quadrifilar helical antenna, of claim 1, wherein spiral rising angles of the main radiating arm and the auxiliary radiating arm are the same or different.

3. The dual-frequency current-balancing quadrifilar helical antenna of claim 2, wherein the feeding part comprises a circular polarized feeding component, the circular polarized feeding component is a network splitting one into four subnets consisting of an electrical bridge or pure media; an input port of the network is connected with the cable; each output port has the same amplitude and a phases difference of 90° in sequence; and four output ports are connected with four sets of spiral arms, respectively.

4. The dual-frequency current-balancing quadrifilar helical antenna of claim 1, wherein a rotation direction of the main radiating arm and the auxiliary radiating arm is right-handed or left-handed; the widths of the main radiating arm and the auxiliary radiating arm are uniform or gradually varied; and the terminals of the main radiating arm and the auxiliary radiating arm are open-circuited or short-circuited.

5. The dual-frequency current-balancing quadrifilar helical antenna of claim 1, wherein the spiral arms are made by printing on a dielectric substrate, and the hollow column is a low-loss material or consists of air.

6. The dual-frequency current-balancing quadrifilar helical antenna of claim 1, wherein the coupling component comprises two coupling plates with flush ends arranged on the main radiating arm and the auxiliary radiating arm, respectively.

7. The dual-frequency current-balancing quadrifilar helical antenna of claim 1, wherein the coupling component comprises two coupling plates with zigzag-shaped ends arranged on the main radiating arm and the auxiliary radiating arm, respectively.

8. The dual-frequency current-balancing quadrifilar helical antenna of claim 1, wherein the coupling component comprises a coupling plate printed on a back of each of the spiral arms.

9. The dual-frequency current-balancing quadrifilar helical antenna of claim 1, wherein an arrangement direction of the coupling component is perpendicular to an overall arrangement direction of the dual-frequency current-balancing quadrifilar helical antenna.

10. A dual-frequency current-balancing quadrifilar helical antenna, comprising:

a radiating part, and a feeding part;

wherein the radiating part comprises a hollow column and 4 sets of spiral arms with same specifications and equal intervals;

the spiral arms are wound on a surface of the hollow column and the feeding part is mounted at an end of the hollow column;

each set of the spiral arms comprises a main radiating arm and an auxiliary radiating arm;

terminals of the main radiating arm and the auxiliary radiating arm are open-circuited or short-circuited and a coupling component is arranged between the main radiating arm and the auxiliary radiating arm, wherein the coupling component includes two coupling plates arranged on the main radiating arm and the auxiliary radiating arm, respectively, and wherein the two coupling plates both include flush ends or zigzag-shaped ends.

11. A dual-frequency current-balancing quadrifilar helical antenna, comprising:

a radiating part, and a feeding part;

wherein the radiating part comprises a hollow column and 4 sets of spiral arms with same specifications and equal intervals;

the spiral arms are wound on a surface of the hollow column and the feeding part is mounted at an end of the hollow column;

each set of the spiral arms comprises a main radiating arm and an auxiliary radiating arm;

terminals of the main radiating arm and the auxiliary radiating arm are open-circuited or short-circuited; and a coupling component is arranged between the main radiating arm and the auxiliary radiating arm, wherein the coupling component includes a coupling plate printed on a back of each of the spiral arms.

* * * * *